US006964493B1

(12) United States Patent
Whitlock

(10) Patent No.: US 6,964,493 B1
(45) Date of Patent: Nov. 15, 2005

(54) METHOD AND APPARATUS FOR ADDING LIGHT TRANSMISSION TO AN ARTICLE OF CLOTHING

(75) Inventor: Mark L. Whitlock, Belleville, IL (US)

(73) Assignee: Whitlock Enterprises, LLC, Belleville, IL (US)

( * ) Notice: Subject to any disclaimer, the term of this patent is extended or adjusted under 35 U.S.C. 154(b) by 210 days.

(21) Appl. No.: 10/346,421

(22) Filed: Jan. 17, 2003

(51) Int. Cl.[7] ..... F21V 21/08
(52) U.S. Cl. ..... 362/103; 362/34; 362/108; 2/102
(58) Field of Search ..... 362/103, 108, 362/34; 2/102

(56) References Cited

U.S. PATENT DOCUMENTS 4,328,533 A * 5/1982 Paredes ..... 362/108
5,485,355 A 1/1996 Voskoboinik et al.
5,613,756 A 3/1997 Allen
5,660,460 A 8/1997 McLeod, Jr.
5,810,467 A 9/1998 Hurwitz
5,869,930 A 2/1999 Baumberg et al.
5,876,863 A 3/1999 Feldman et al.
5,879,076 A 3/1999 Cross
6,030,089 A 2/2000 Parker et al.
6,086,213 A 7/2000 Holce
6,146,006 A 11/2000 Cross
6,193,385 B1 2/2001 Maki et al.
6,207,077 B1 3/2001 Burnell-Jones
6,302,558 B1 10/2001 Parks
6,769,138 B2 * 8/2004 Golle et al. ..... 2/102

* cited by examiner

*Primary Examiner*—Thomas M. Sember
*Assistant Examiner*—James W Cranson
(74) *Attorney, Agent, or Firm*—Thompson Coburn LLP

(57) ABSTRACT

A method and apparatus for light transmission comprising a garment, covering, or clothing, combined with a light distribution system adapted for distributing a pattern of light over the garment covering, or clothing. The light distribution system may include a light source combined with a separate fluorescent or phosphorescent material.

23 Claims, 3 Drawing Sheets

METHOD AND APPARATUS FOR ADDING LIGHT TRANSMISSION TO AN ARTICLE OF CLOTHING

BACKGROUND OF THE INVENTION (1) Field of the Invention

The present invention pertains to a method and apparatus for combining light transmission with an article of clothing. More specifically, the present invention pertains to a kit and its method of use, where the kit contains one or more sources of illumination, one or more supporting devices for supporting each illumination source and one or more attaching devices. The attaching devices are employed according to the method in securing the supporting devices to an article of clothing where the supporting devices, once secured to the clothing, will support the illumination source on clothing thereby combining light transmission with the article of clothing. In the preferred embodiment the supporting device is designed to enable the illumination source to be easily removed from the supporting device and the article of clothing to which it is attached, or the attaching device is designed as a removably attachable attaching device whereby the supporting device and the illumination device it supports can be easily removed from the article of clothing for periodic cleaning of the article of clothing.

(2) Description of the Related Art

Either for safety or for entertainment purposes, there are situations where it is desirable to an individual to make their body more visible to others and/or make the body of their pet more visible to others. Examples of these situations include a child walking to school or waiting for a school bus in the pre-dawn hours of the winter months, a jogger jogging during pre-dawn hours, an individual walking their dog before sunrise or after sunset, or an individual that desires to add illumination to their body as part of a costume or for other similar entertainment purposes. Reflectors that reflect light have long been used for safety purposes on articles of clothing such as shoes, jogging pants and jackets and safety vests worn by highway work crews and others whose professions require them to be working along the roadways in dark conditions. However, these light reflective surfaces are typically permanently secured to the articles of clothing. Repeated cleaning of the clothing over time can have the effect of deteriorating the ability of the light reflective surface to reflect light.

It is has also been known to permanently secure a series of small electric lights connected by a length of wiring to an article of clothing such as pants or a shirt by sewing the length of wiring and the attached lights to the article of clothing. Again however, if it desired to clean the article of clothing it would be necessary to remove all of the thread holding the wiring and lights to the clothing in order to avoid the wiring and lights becoming damaged when the article of clothing is cleaned. Sewing the length of wiring and attached lights to the article of clothing and removing the sewing thread from the clothing to remove the length of wiring and attached lights each time the article of clothing is cleaned is very labor intensive and expensive.

SUMMARY OF THE INVENTION

The present invention overcomes the above-described disadvantages of reflective or light transmitting components added to an article of clothing for a person or a pet by providing an apparatus and its method of use that easily attaches an illumination source to an article of clothing where the illumination source is also easily removed from the article of clothing for periodic cleaning of the clothing. In the preferred embodiment the illumination source is an elongate, flexible cord that communicates with a power source at one end of the cord through a switch. The switch can be manually operated to selectively illuminate the cord along its entire length.

One or more supporting devices are provided that can be removably attached to the illumination source cord to support the cord. The supporting device can have a variety of forms. For example, the support device could be a transparent length of tubular piping or a transparent tubular sleeve that is secured along a seam or is secured in a desired pattern on the article of clothing. The cord of the illumination source is extended through the interior of the piping or sleeve whereby the piping or sleeve supports the illumination source cord on the article of clothing. The support device could also have various other forms, for example eyelets or hoops that are attached to the clothing at various locations and through which the illumination source cord is inserted. Basically, anything that could function to support the illumination source cord in a desired pattern on the article of clothing could be included as a support device.

The support device is secured in its desired position on the article of clothing by an attaching device. The attaching device also can have many forms. For example, the attaching device could be a length of thread that sews the support device to the article of clothing in its desired position. In this example it would be necessary that the support device removably support the illumination source cord so that the cord could be separated from the article of clothing for periodic cleaning of the clothing. In other examples the attaching device could be a button, snap, zipper, or other fastener like a hook and loop fastener that removably attaches the support device to the article of clothing. In these examples the support device could be removed from the article of clothing with the illumination source cord still attached to the support device in order the clean the clothing.

In one embodiment of the invention the illumination source, the support device and the attaching device could be provided in combination with the article of clothing. In a preferred embodiment the illumination source, support device and attaching device is provided as a kit that is separate from an article of clothing with which the kit is to be used. The kit would also include the manually operable switch for controlling a supply of power to the illumination source, for example from separate batteries, as well as a set of instructions presenting a method on how to attach the illumination source in a desired pattern to a separate article of clothing employing the support device and attaching device.

From the description provided above it can be seen that the illumination source, support device and attaching device of the present invention, whether provided in combination with an article of clothing or provided in a kit to be used on a separate article of clothing provides for the attachment of an illumination source to an article of clothing for safety or entertainment purposes or both, where the illumination source can be easily removed from the article of clothing for periodic cleaning of the clothing and then easily reattached to the article of clothing.

BRIEF DESCRIPTION OF THE DRAWINGS

Further features of the present invention as set forth in the following detailed description of the preferred embodiments of the invention and in the following drawing figures wherein.

DETAILED DESCRIPTION OF THE PREFERRED EMBODIMENT

Figure 1:
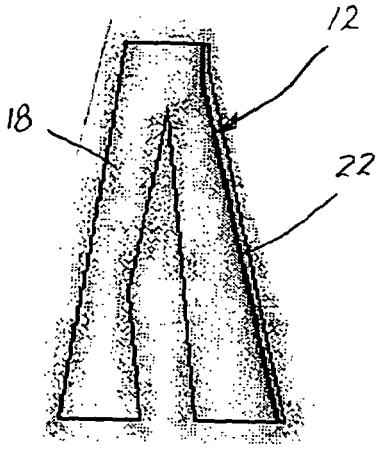
FIG. 1 is a schematic representation of one embodiment of the invention combined with an article of clothing, i.e. a pair of pants.
Figure 2:
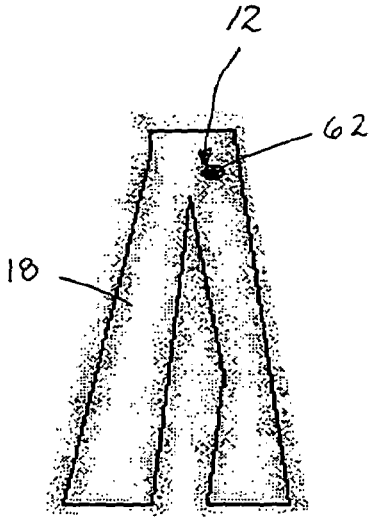
FIG. 2 is a schematic representation of a second embodiment of the invention combined with an article of clothing.
Figure 3:
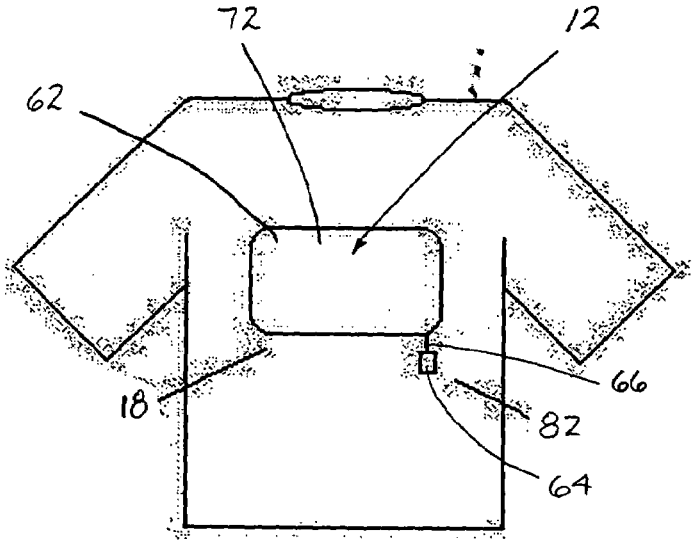
FIG. 3 is a schematic representation of a further embodiment of the invention combined with an article of clothing, i.e. a shirt.

The present invention provides an illumination source 12 that is supported by a supporting device 14 that in turn is attached by an attaching device 16 to an article of clothing. FIGS. 1, 2 and 3 are schematic representations of various embodiments of the illumination source 12 attached to articles of clothing 18. The articles of clothing 18 shown in the drawing figures are only examples of articles of clothing to which the illumination source 12 of the invention could be attached and should not be interpreted as limiting. It is intended that the articles of clothing include anything that would typically be worn by a person (including articles like jewelry) or a pet. In addition, the particular configuration of the illumination source 12 disclosed herein are for illustrative purposes only. It should be understood that the illumination source 12 of the invention could have a variety of configurations different from those discussed. As discussed earlier, the illumination source 12 is attached to the article of clothing 18 for safety, entertainment and/or amusement purposes which will influence the particular article of clothing to which the illumination source 12 is attached and the configuration that the illumination source 12 has on the article of clothing. The illumination source 12 could be removably attached to the article of clothing 18 in the manners to be explained as an integral part of the article of clothing when the article of clothing is purchased. However, in the preferred embodiment the illumination source 12 is provided as part of a kit that also basically includes one or more supporting devices 14 for the illumination source 12 and one or more attaching devices 16 that attach the supporting device 14 to a separate article of clothing 18.

In a first embodiment of the invention the illumination source 12 has a configuration of an elongate flexible cord or strip 22 having opposite proximal 24 and distal 26 ends. The illumination source cord could be constructed in a variety of manners.

The illumination source cord or flat strip 22 could be an electro-luminescent element that provides low temperature emission of light in response to application of an alternating current to a layer of phosphor that extends through the interior of the cord 22 between its proximal 24 and distal 26 ends. Electro-luminescent elements of this type are known in the art and examples are disclosed in the U.S. Patent of Voskoboinik, et al. U.S. Pat. No. 5,485,355 and the U.S. Patent of Baumberg, et al. U.S. Pat. No. 5,869,930. The length of the cord or strip configuration of the electro-luminescent element may be cut adjacent its distal end 26 to adjust the length to a desired length to be attached to the article of clothing. Because the length of the electro-luminescent cord 22 is illuminated by application of an alternating current to the element, the element requires a small and portable power supply that is included as a component part of the kit.

Figure 7:
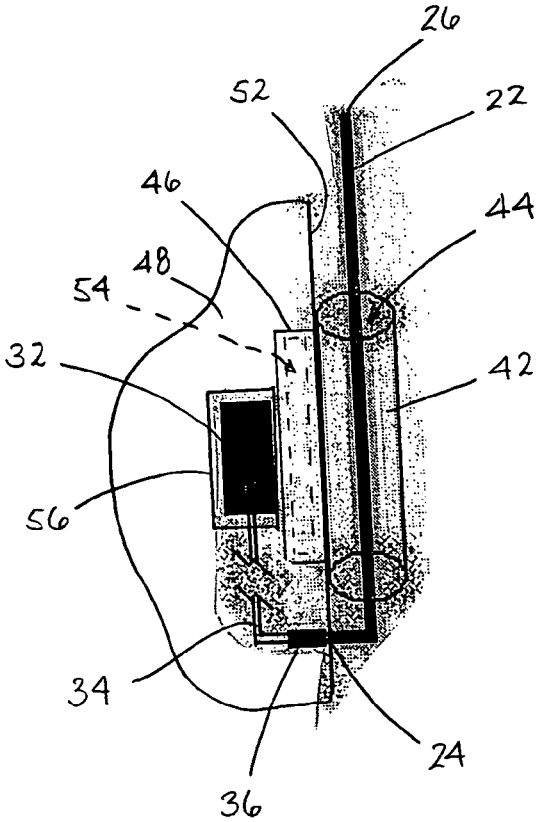
FIG. 7 is a schematic representation of the supporting device of FIG. 5 supporting a further embodiment of the illumination source.

FIG. 7 shows a schematic representation of a power supply 32 that, in the preferred embodiment, includes a power source of one or more DC batteries, a manually operable switch and an inverter/sequencer that converts the DC power of the batteries to AC power for the electro-luminescent cord 22. The power source 32 can provide continuous current to the electro-luminescent element of the illumination source cord 22 to continuously illuminate the cord along its entire length. Alternatively, the power source 32 could be modified to intermittently interrupt the current supplied to the electro-luminescent element of the illumination source cord 22 to cause the length of the cord to blink. In the preferred embodiment conductors 34 that communicate the power source 32 with the proximal end 24 of the illumination source cord 22 would be provided with a releasable connection 36, for example mating plugs, that enable the power source 32 to be disconnected from the length of the illumination source cord 22 when removing the power source and cord from the article of clothing 18 to which they are attached.

Figure 4:
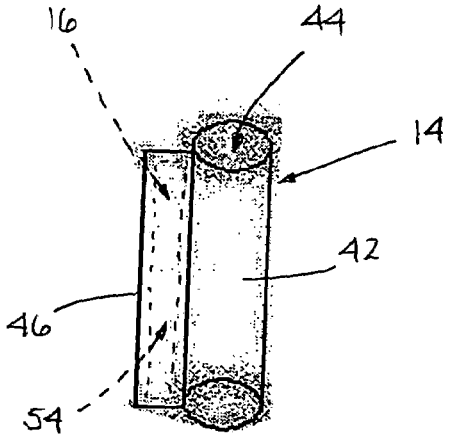
FIG. 4 is a schematic representation of one embodiment of the supporting device of the invention.

FIGS. 4–7 show an embodiment of a supporting device 14 that is secured by an attaching device 16 to an article of clothing 18. The supporting device may be used in supporting the illumination source cord 22. FIG. 4 shows a tubular piping or sleeve 42 having a length and a hollow interior bore 44 that extends through the length of the piping. The piping 42 is preferably constructed of transparent material that will allow a portion of the illumination source 12 contained in the piping interior bore 44 to be visible through the piping. The piping 42 is provided with a flap 46 along its length that projects a short distance outwardly from the piping. The flap 46 is used with an attaching device for attaching the piping 42 to an article of clothing.

Figure 5:
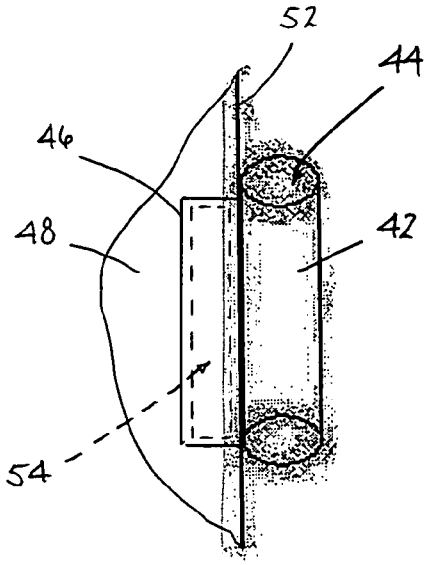
FIG. 5 is a schematic representation of the supporting device of FIG. 4 attached to an article of clothing.
Figure 6:
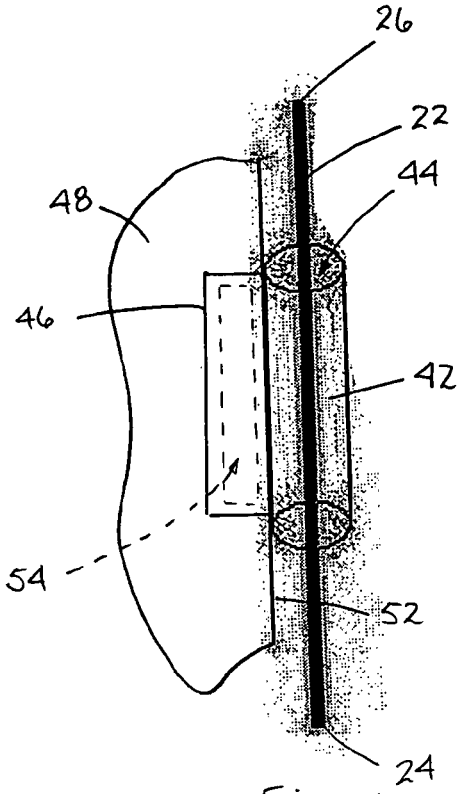
FIG. 6 is a schematic representation of the supporting device of FIG. 5 supporting an illumination source.

FIG. 5 shows the piping 42 attached to an article of clothing 48 which is shown only partially in FIG. 5. FIG. 6 shows a portion of the illumination source cord 22 inserted through the interior bore 44 of the piping segment 42. In this manner, the piping 42 supports the illumination source cord 22 on the article of clothing. The piping 42 is shown as a single, short segment of the piping attached along a seam 52 of the article of clothing. The supporting device 14 could be provided by a plurality of piping segments such as the piping segment 42 shown in FIG. 5 that are spatially arranged along the seam 52 of the article of clothing, for example being spatially arranged on a seam extending along a pant leg. Alternatively, the piping 42 could be one continuous segment that extends along the entire seam and along the entire length of the pant leg. Furthermore, the piping segments could be spatially arranged in a variety of different patterns on the article of clothing to support the length of the illumination source 12 in the pattern defined by the plurality of piping segments. Still further, a continuous length of piping could be arranged in a desired pattern on an article of clothing with the continuous length of piping supporting the length of the illumination source 12 on the clothing.

In the illustrated embodiment of FIG. 5, the piping segment 42 is secured to the article of clothing 48 by an hook and loop fastener 54 that removably attaches the piping flap 46 to the article of clothing 48. The hook and loop fastener 54 is represented by the dashed line rectangle in FIG. 5. The hook portion of the fastener is attached to one of the article of clothing 48 and the piping flap 46, and the loop portion of the fastener is attached to the other of the article of clothing and the flap. In this manner, the piping segment 42 is removably attached to the article of clothing 48 by the hook and loop fastener 54.

FIG. 7 shows a segment of piping 42 supporting the illumination source cord 22 on the article of clothing 48 adjacent the cord proximal end 24. Also shown in FIG. 7 is the power source needed for the electro-luminescent illumination source cord. The power source 32 could be supported on the article of clothing 48 by a pocket 56 specifically designed to be added to the article of clothing to receive the power source. Alternatively, a removable pocket that is removably attached to the article of clothing, for example by the hook and loop fasteners 54 employed in removably attaching the piping 42 to the article of clothing 48 could also be used to secure the pocket to the article of clothing enclosing the power source 32 in the pocket.

The piping 42 described above is only one example of a supporting device 14 that can support the illumination source 12 from an article of clothing 18. It should be understood that other types of tubular sleeves or pockets could be used as a supporting device 14. In addition, individual eyelets or hooks or hoops could be removably attached to the article of clothing to function as the supporting device 14. Still further, a strand of jewelry wire or thread could be wrapped around the length of illumination source cord 22 to function as the supporting device.

It should also be understood that the hook and loop fastener 54 described above as the attaching device is only one example of an attaching device that could be used with the illumination source 12 of the invention. Other attaching devices that could be used to removably attach the supporting device 14 to the article of clothing 18 could include buttons, snaps, grommets, zippers, magnets, clips, clamps, or two-sided tape, to name a few examples.

The illumination source cord 22 being an electro-luminescent element is only one example of an illumination source that could be employed with the present invention. Another example of an illumination source is a phosphorescent element having the elongate configuration of a phosphorus impregnated cord or strip. A phosphorescent element would also provide low temperature emission of light caused by the absorption of incident radiation at one wavelength followed by delayed re-radiation at a different wavelength that continues for a noticeable time after the incident radiation is removed. Illumination materials of this type are commonly referred to as "glow in the dark" materials.

Alternatively, the illumination source could be a florescent element provided in the elongated cord or strip configuration. A florescent element provides low temperature emission of light caused by absorption of incident radiation at one wave length followed by nearly immediate re-radiation at a different wave length that stops when the incident radiation stops. These materials are commonly referred to as "light reflective" materials.

Other examples of the illumination source include LEDs, very small light bulbs connected along a length of wiring that could be threaded through the supporting devices, or similar illumination devices.

Because the phosphorescent element and the florescent element would require no power source for illumination, it would not be necessary to accommodate a power source on the article of clothing when the illumination source is a phosphorescent element or a florescent element.

In a still further variant embodiment of the invention an electro-luminescent element could be combined with either a phosphorescent element or a florescent element in the illumination source of the invention.

FIGS. 3, 8, 9, and 10 show a further embodiment of the illumination source, support device and attaching device of the invention. In this embodiment the illumination source can be an electro-luminescent element, a phosphorescent element, or a florescent element as in the earlier described embodiment. However, the illumination source is not configured as an elongate cord or strip 22, but is configured as a flexible panel 62.

When the illumination source panel 62 is constructed as an electro-luminescent element, it is necessary that the kit also include a power source for the illumination source panel 62. As in the previously described embodiment, the power source 64 is comprised of one or more DC batteries that is connected through a manually operable switch to an inverter/sequencer. All of these component parts are included in the power source 64 schematically represented in FIGS. 3 and 10. The power source 64 communicates through electrical conductors 66 with the illumination source panel 62. Releasable connectors 68, for example, plug connectors, are provided along the electrical conductors 66 to selectively separate the power source 64 from the illumination source panel 62 when the power source and panel are removed from the article of clothing for cleaning of the article of clothing.

As with the first described embodiment of the illumination source, the illumination source panel 62 could alternatively be constructed of a phosphorescent element or a florescent element which would not require the power source 64 for illumination. In these variant embodiments of the invention the power source and its conductors and releasable connectors would be eliminated.

Figure 9:
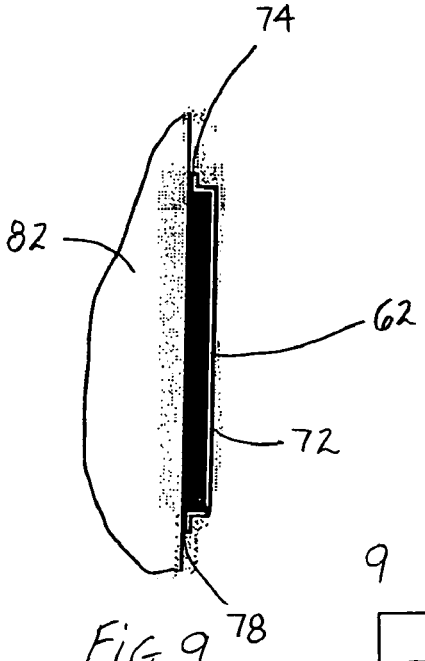
FIG. 9 is a schematic representation of the side view of FIG. 8 along the line 9—9 of FIG. 8.
Figure 8:
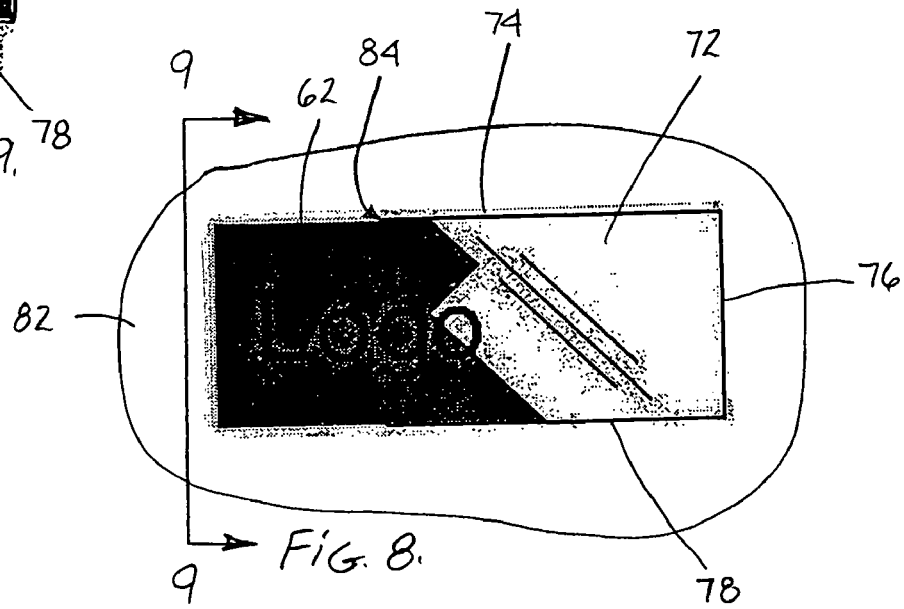
FIG. 8 is a schematic representation of a further embodiment of the supporting device supporting a further embodiment of an illumination source on an article of clothing.
Figure 10:
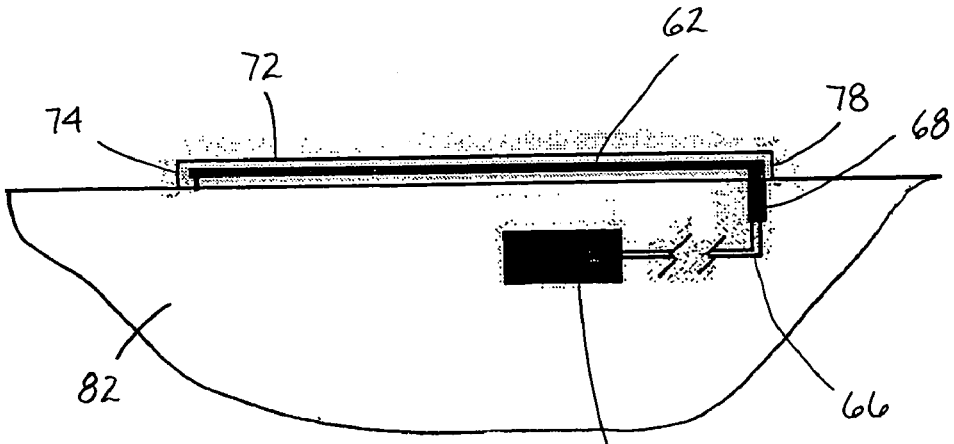
FIG. 10 is a side view of the supporting device of FIG. 9 supporting a further embodiment of the illumination source.

The embodiment of FIGS. 8, 9, and 10 shows the supporting device configured as a pocket or enclosure 72. As in the first embodiment, the pocket 72 would be constructed of a transparent material that would allow the illumination of the illumination source panel 62 to be viewed through the material of the pocket. The pocket 72 has a rectangular configuration and is secured along three sides 74, 76, 78 of the pocket to the article of clothing 82 which is shown partially in the drawing figures. The three sides, 74, 76, 78 of the pocket could be permanently attached to the article of clothing 82 by sewing or other means where the material of the pocket 72 could be cleaned with the article of clothing. Alternatively, the three sides 74, 76, 78 of the pocket would be attached by one of the attaching devices described earlier with reference to the first described embodiment of the invention. For example, the pocket 72 would be dimensioned slightly larger than the dimensions of the illuminations source panel 62 to provide three edge flaps along the three sides 74, 76, 78 of the pocket. Each of these edge flaps would have one portion of a hook and loop fastener secured to it with the other portion of the hook and loop fastener being secured to the article of clothing 82. This would removably attach the pocket 72 to the article of clothing 82. Alternatively, one of the other attaching devices described earlier with reference to the first embodiment could be employed to removably attach the pocket 72 to the article of clothing. This enables the pocket 72 to be removed from the clothing as well as the illumination source panel 62 being removed from the clothing for periodic cleaning of the clothing. FIGS. 8, 9, and 10 show how the illumination source panel 62 is inserted through the open side 84 of the pocket 74 into the interior volume of the pocket defined between the pocket 72 and the article of clothing 82. And example of this type of illumination source panel 62 is shown used with a shirt in FIG. 3 and with a pair of pants in FIG. 2. As represented in FIG. 8, the illumination source panel 62 may be employed with the article of clothing 82 not only as a safety means or an entertainment or amusement means, but could also be employed as an advertising means with the panel displaying a logo or trademark.

In accordance with the invention, a kit is provided to enable a person to add the illumination source to an article of clothing. The kit comprises at least one of each of the illumination source 12, the supporting device 14 and the attaching device 16 as described above. The kit can also include a power supply 36 and a pouch 34 to hold the power supply. The kit can also include instructions and a template to create a design pattern (not shown). The kit can be housed in common packaging (not shown).

In operation, a person wishing to become more visible to others can wear clothing that incorporates a light source. The clothing can be provided with the component parts of the kit being integral with the clothing, or the kit as described above can be used to modify an existing article of clothing. Using the illumination source 12 provided in the kit, a desired location for the illumination source 12 can be determined and the illumination source can be trimmed to the appropriate dimensions. In the case of a cord shaped electro-luminescent element as the illumination source 12, the trimmed element can be sealed using any acceptable means. The supporting device 14 from the kit is then assembled to the illumination source along its length. The attaching device 16 then attaches the supporting device and the illumination source to the article of clothing at the desired location. If the illumination source 12 includes an electro-luminescent element, the power supply 32 can be secured to the article of clothing using the pouch described earlier. The power supply is connected to the electro-luminescent element by turning the switch to the on position to provide illumination. With the switch turned to the off position the electro-luminescent element provides no illumination, but if the illumination source includes a re-radiation light source, it will provide additional illumination.

The combination illumination source and clothing can be useful in a variety of situations. For example, a combination according to the invention could be used to increase safety. In dark or dimly lit situations, pedestrians can benefit from being more easily seen. An illumination source supported by a supporting device and attached by an attaching device to an article of clothing can provide illumination of the pedestrian. Another example would be to enhance the visual appearance of a performer. The performer could be part of an event such as a stage performance or a theatrical production. The performer could also be part of a social gathering, such as a dance party.

After any of the uses described above, the illumination source can be removed from the article of clothing. The article of clothing can then be washed and used again. The illumination source on an article of clothing can also be switched for another illumination source. An electro-luminescent element of one color can be replaced with an electro-luminescent element of another color. An electro-luminescent element can be replaced with a phosphorescent or fluorescent element (re-radiant light source).

As various changes could be made in the above constructions and methods without departing from the scope of the invention, it is intended that all matter contained in the above description or shown in the accompanying drawings shall be interpreted as illustrative and not in a limiting sense. Thus, the breadth and scope of the present invention should not be limited by any of the above-described exemplary embodiments, but should be defined only in accordance with the following claims appended hereto.

What is claimed is:

1. A kit for providing illumination to an article of clothing, the kit comprising:

an illumination source in the kit having an elongate, flexible length;

a supporting device in the kit attached to the illumination source along the length of the illumination source; and an attaching device in the kit on the supporting device adapted to attach the supporting device to an article of clothing.

2. The kit as set forth in claim 1, further comprising:

the supporting device being selected from the group of supporting devices consisting of a piping, a sleeve, a pocket, an eyelet, a hook, an enclosure, a jewelry wire, and a hoop.

3. A kit for providing illumination to an article of clothing, the kit comprising:

an illumination source having an elongate, flexible length;

a supporting device attached to the illumination source along the length of the illumination source;

an attaching device on the supporting device adapted to attach the supporting device to an article of clothing; and, the supporting device being a piping having a tubular interior volume and an exterior flap on the piping, the tubular interior volume being dimensioned to receive support the illumination source.

4. The kit as set forth in claim 3, further comprising:

the piping being one of a plurality of separate piping segments.

5. The kit as set forth in claim 3, further comprising:

the piping having a piping length equal to the illumination source length.

6. The kit as set forth in claim 3, further comprising:

the attaching device being selected from a group of attaching devices consisting of a thread, a button, a glue, a snap, a grommet, a zipper, a double sided tape, a magnet, a clip, a clamp, and a hook and loop fastener.

7. The kit as set forth in claim 3, further comprising:

the attaching device being a thread, the thread having sufficient strength to attach the illumination source and the supporting device to an article of clothing.

8. The kit as set forth in claim 1, further comprising:

the illumination source being an electro-luminescent element adapted to provide a low temperature emission of light from an application of an electrical current to the electro-luminescent element, the electro-luminescent element having an electrical connection adapted to receive the electrical current; and a power supply communicating with the illumination source, the power supply having a battery, a switch and a lead, the lead being adapted to operatively connect the power supply to the electrical connection of the electro-luminescent element.

9. The kit as set forth in claim 1, further comprising:

the illumination source being a phosphorescent element adapted to provide a low temperature emission of light.

10. A kit for providing illumination to an article of clothing, the kit comprising:

an illumination source having an elongate, flexible length;

a supporting device attached to the illumination source along the length of the illumination source;

an attaching device on the supporting device adapted to attach the supporting device to an article of clothing; and, the illumination source being a combination of an electro-luminescent element adapted to provide a low temperature emission of light from an application of an electrical current to the electro-luminescent element and a phosphorescent element and;

a power supply communicating with the illumination source, the power source having a battery, a switch and a lead, the lead being adapted to operatively connect the power supply to the electro-luminescent element.

11. The kit as set forth in claim 10, further comprising:

the phosphorescent element being a hollow tube having an interior space that is dimensioned to receive the electro-luminescent element within the hollow tube interior space.

12. The kit as set forth in claim 1, further comprising:

a set of instructions for attaching the illumination source to an article of clothing.

13. A kit for providing illumination to an article of clothing, the kit comprising;

an illumination source having an elongate, flexible length;

a supporting device attached to the illumination source along the length of the illumination source;

an attaching device on the supporting device adapted to attach the supporting device to an article of clothing;

a set of instructions for attaching the illumination source to an article of clothing; and, a template having a design pattern on the template for use in placement of the illumination source in the design pattern on an article of clothing.

14. The kit as set forth in claim 13, further comprising:

a pouch attachable to an article of clothing, the pouch having an interior portion dimensioned to hold a power supply communicating with the illumination source, the power source having a battery, a switch and a lead, the lead being adapted to operatively connect the power supply to the electro-luminescent element.

15. The kit as set forth in claim 14, further comprising:

the illumination source, the power supply, the supporting device, the attaching device, the set of instructions, the template and the pouch being contained together in a common packaging.

16. The kit as set forth in claim 1, further comprising:

the illumination source being a fluorescent element adapted to provide a low temperature emission of light.

17. A method of providing illumination to an article of clothing using a kit as set forth in claim 1, the method comprising the steps of:

assembling the illumination source to the supporting device;

affixing the supporting device to the article of clothing using the attaching device.

18. A method of providing illumination to an article of clothing using a kit as set forth in claim 10, the method comprising the steps of:

assembling the illumination source to the supporting device;

affixing the supporting device to the article of clothing using the attaching device;

attaching the power supply to the electro-luminescent element by connecting the lead of the power supply to the electrical connection of the electro-luminescent element.

19. A method as set forth in claim 18, further comprising:

applying an electrical current to the electro-luminescent element causing the emission of light for a first period of time, the phosphorescent element absorbing the light;

stopping the application of the electrical current to the electro-luminescent element such that the phosphorescent element provides emission of light for a second period of time.

20. An article of clothing comprising:

a fabric adapted to be used to cover a portion of a user's body;

an attaching device removably attached to a portion of the fabric;

a supporting device operatively connected to the attaching device;

an illumination source operatively connected to the supporting device.

21. An article of clothing comprising:

a fabric adapted to be used to cover a portion of a user's body;

an attaching device removably attached to a portion of the fabric;

a supporting device operatively connected to the attachment device;

an illumination source operatively connected to the supporting device;

the illumination source being a combination of an electro-luminescent element adapted to provide a low temperature emission of light from an application of an electrical current to the electro-luminescent element, the electro-luminescent element having an electrical connection adapted to receive the electrical current, and a phosphorescent element adapted to provide a low temperature emission of light;

a power supply having a battery, a switch and a lead, the lead being adapted to operatively connect the power supply to the electrical connection of the electro-luminescent element, and a pouch attached to the article of clothing, the pouch having an interior portion dimensioned to hold the power supply.

22. The article of clothing as set forth in claim 21, further comprising;

the illumination source being supported by the supporting device and attached to the article of clothing in a predetermined pattern.

23. The article of clothing as set forth in claim 21, further sing:

the illumination source having a configuration of a logo to display the logo illuminated.

* * * * *